US010473285B2

(12) United States Patent
Mornet et al.

(10) Patent No.: US 10,473,285 B2
(45) Date of Patent: Nov. 12, 2019

(54) LIGHTING MODULE FORMING A LIGHT PATTERN DIVIDED INTO A SHARP UPPER PORTION AND A FUZZY LOWER PORTION

(71) Applicant: VALEO VISION, Bobigny (FR)

(72) Inventors: Eric Mornet, Bobigny (FR); Marine Courcier, Bobigny (FR); Alexandre Joerg, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/158,502

(22) Filed: Oct. 12, 2018

(65) Prior Publication Data

US 2019/0113198 A1 Apr. 18, 2019

(30) Foreign Application Priority Data

Oct. 13, 2017 (FR) ..... 17 59636

(51) Int. Cl.

| | |
|---|---|
| ***F21S 41/153*** | (2018.01) |
| ***F21S 41/143*** | (2018.01) |
| ***F21S 41/24*** | (2018.01) |
| ***F21S 41/275*** | (2018.01) |
| ***F21S 41/27*** | (2018.01) |

(Continued)

(52) U.S. Cl.

CPC ..... *F21S 41/153* (2018.01); *F21S 41/143* (2018.01); *F21S 41/24* (2018.01); *F21S 41/255* (2018.01); *F21S 41/27* (2018.01); *F21S 41/275* (2018.01); *F21S 41/322* (2018.01); *F21S 41/663* (2018.01); *F21Y 2115/10* (2016.08)

(58) Field of Classification Search

CPC ..... F21S 41/143; F21S 41/24

See application file for complete search history.

(56) References Cited

U.S. PATENT DOCUMENTS

2008/0170407 A1* 7/2008 Meyrenaud ..... F21S 41/336 362/507
2009/0091944 A1* 4/2009 de Lamberterie ... G02B 6/0045 362/516

(Continued)

FOREIGN PATENT DOCUMENTS

DE 20 2011 103 805 U1 1/2012
DE 10 2012 213 845 A1 2/2014

(Continued)

OTHER PUBLICATIONS

French Preliminary Search Report dated May 11, 2018 in French Application 17 59636, filed on Oct. 13, 2017 (with English Translation of Categories of Cited Documents).

*Primary Examiner* — Alexander K Garlen

(74) *Attorney, Agent, or Firm* — Oblon, McClelland, Maier & Neustadt, L.L.P.

(57) ABSTRACT

A lighting module for a motor vehicle headlight including at least one light source and optical elements for forming at least one light pattern, characterized in that each light pattern is divided into an upper portion and a lower portion which are lit simultaneously and inseparably, the upper portion being delimited transversely by two vertical edges for each of which the light intensity decreases according to a first determined gradient, and the lower portion being delimited transversely by two vertical edges for each of which the light intensity decreases according to a second determined gradient lower than the first determined gradient.

19 Claims, 5 Drawing Sheets

(51) Int. Cl.

| | |
|---|---|
| ***F21S 41/663*** | (2018.01) |
| ***F21S 41/32*** | (2018.01) |
| ***F21S 41/255*** | (2018.01) |
| ***F21Y 115/10*** | (2016.01) |

(56) References Cited

U.S. PATENT DOCUMENTS

| | | | | |
|---|---|---|---|---|
| 2012/0275173 | A1* | 11/2012 | Hamm | B60Q 1/1423 362/487 |
| 2014/0042325 | A1 | 2/2014 | Yamamura | |
| 2015/0085523 | A1* | 3/2015 | Gurtl | F21S 41/143 362/607 |
| 2015/0167913 | A1 | 6/2015 | Stefanov et al. | |
| 2015/0226395 | A1* | 8/2015 | Taudt | F21S 41/24 362/511 |
| 2016/0201867 | A1* | 7/2016 | Moser | F21S 41/255 362/520 |
| 2016/0215946 | A1* | 7/2016 | Kieslinger | F21S 41/275 |
| 2017/0089536 | A1* | 3/2017 | Courcier | F21S 41/143 |
| 2017/0276309 | A1 | 9/2017 | Nakazawa et al. | |
| 2018/0105095 | A1 | 4/2018 | Taudt et al. | |
| 2018/0128443 | A1* | 5/2018 | Taudt | F21S 41/141 |

FOREIGN PATENT DOCUMENTS

| | | | |
|---|---|---|---|
| DE | 10 2014 216 545 | A1 | 2/2016 |
| EP | 2 700 538 | A1 | 2/2014 |
| WO | WO 2016/149721 | A1 | 9/2016 |
| WO | WO 2016/190165 | A1 | 12/2016 |

* cited by examiner

LIGHTING MODULE FORMING A LIGHT PATTERN DIVIDED INTO A SHARP UPPER PORTION AND A FUZZY LOWER PORTION

TECHNICAL FIELD OF THE INVENTION

The invention relates to a lighting module for a motor vehicle headlight comprising at least one light source and optical elements for forming at least one light pattern.

TECHNICAL BACKGROUND OF THE INVENTION

Light modules of this type are already known. Such light modules are capable of producing a lighting light beam, for example a high beam, divided into light patterns forming pixels that can be switched off selectively. That makes it possible for example to light the road and its environment optimally while avoiding dazzling the users of the road.

Such light modules are called "pixel beam" light modules. It is for example possible to divide the overall light beam into a matrix of pixels or even into vertical bands.

Some, so-called overlapping, light patterns, that make up the pixel light beam light, for a lower first part, the road in proximity to the vehicle and, for an upper second part, above the road.

When an overlapping light pattern is switched off selectively, a shadow zone is created on the road. This shadow zone is delimited transversely by the vertical edges of the two adjacent overlapping light patterns that are switched on.

However, each overlapping light pattern is delimited by vertical edges which are substantially sharp over all their height. The result thereof is that the lower part of said adjacent overlapping light patterns delimits the shadow zone by boundaries which appear sharply on the road surface. These sharp boundaries draw the attention of the driver thus reducing his or her vigilance, even causing confusion.

BRIEF SUMMARY OF THE INVENTION

The invention proposes a lighting module for a motor vehicle headlight comprising at least one light source and optical elements for forming at least one light pattern, characterized in that each light pattern is divided into an upper portion and a lower portion which are lit simultaneously and inseparably, the upper portion being delimited transversely by two vertical edges for each of which the light intensity decreases according to a first determined gradient and the lower portion being delimited transversely by two vertical edges for each of which the light intensity decreases according to a second determined gradient lower than said first determined gradient.

With the gradient of the vertical edges of the upper portion being higher than the gradient of the vertical edges of the lower portion, said vertical edges will be qualified, in relation to one another, as "sharp", for those of the upper portion, and as "fuzzy", for those of the lower portion.

This makes it possible to avoid having the attention of the driver being drawn by the contrast line forming the boundary between the zone of the surface of the road lit by the bottom of the light pattern and the zone of the surface of the road remaining in shadow, while making it possible to light a precise zone on the road and above the road which is delimited by sharp vertical edges. This is particularly useful for pixel beams or segmented beams producing high beam or low beam functions. In a nonlimiting manner, the invention is for example applicable to:

- adaptive beams, also known by the acronym "ADB", meaning "adaptive driving beam", which make it possible to light the road with high beams while selectively switching off zones likely to dazzle the users of the road that are detected automatically;
- bending light beams, also known by the acronym "LBB", meaning "low beam bending", which make it possible to light the road with low beams with a range which is adapted as a function of the turns taken by the vehicle;
- so-called "motorway" beams which are beams with cutoffs suitable for driving on motorways, the cutoff line being notably higher than the cutoff line of a normal low beam;
- low beams suitable for driving in towns or even low beams suitable for driving in rainy weather.

According to other features of the invention:

- the first determined gradient is greater than 0.13, preferably greater than 0.30; this makes it possible to obtain a vertical edge that is sufficiently sharp to make it possible to leave a very precise shadow zone on top of the road so as not to dazzle the users of the road, while adequately lighting alongside this shadow zone to allow the driver to drive comfortably;
- the second determined gradient is less than 0.2, preferably less than 0.13; this makes it possible to not draw the attention of the driver to the boundary between the zone of road surface lit by the lower portion of the light pattern and the zone remaining in shadow;
- at least one vertical edge of the lower portion is arranged in the vertical extension of the vertical edge of the upper portion;
- the two vertical edges of the lower portion are arranged in the extension of each vertical edge of the upper portion;
- at least one vertical edge of the lower portion is offset transversely relative to the corresponding vertical edge of the upper portion, said vertical edge being linked to said vertical edge by a horizontal edge;
- the light pattern lights over a field width less than 10°; this makes it possible to produce a pixel beam having a sufficiently fine resolution;
- the lighting module forms several light patterns that are contiguously aligned transversely and controlled independently of one another to participate in the formation of a pixel light beam producing a determined lighting function;
- the lighting module comprises a primary optical element associated with a plurality of light sources each of which is associated with a light pattern, the primary optical element comprising light guides each associated with one of the light sources and a light output face;
- the lighting module comprises a primary optical element associated with a plurality of light sources each of which is associated with a light pattern, the primary optical element comprising light guides each associated with several of the light sources and a light output face;
- the lower part of the light patterns is produced by joining a corresponding part of the lateral faces of the adjacent light guides to form a forming layer, the upper part of the light patterns being produced by a portion of the lateral faces of the light guides separated transversely from one another; this makes it possible to obtain light patterns produced according to the teachings of the invention in a simple and inexpensive manner;
- the output face of the primary optical element has means for transversely spreading the light rays intended to light the lower part of the light pattern; this is another way of obtaining light patterns produced according to the teachings of the invention in a simple and inexpensive manner;

the light spreading means are formed by refractive or diffractive structures produced on the output face, such as structures in the form of cushions, a graining, striations, undulations, prisms or any other form suitable for producing the light spreading function.

The invention relates also to a motor vehicle headlight comprising at least one lighting module produced according to the teachings of the invention.

BRIEF DESCRIPTION OF THE FIGURES

Other features and advantages of the invention will become apparent on reading the following detailed description, for an understanding of which reference will be made to the attached drawings in which:

FIG. 10 is view in horizontal cross section along the cutting plane 10-10 of FIG. 8 which represents the lighting module as a whole in which a single light source is switched on;

FIG. 11 is a view in horizontal cross section along the cutting plane 11-11 of FIG. 8 which represents the lighting module as a whole in which a single light source is switched on;

DETAILED DESCRIPTION OF THE FIGURES

Hereinafter in the description, the following orientations will be adopted: longitudinal, directed from back to front in the direction of movement of the vehicle, vertical, directed from bottom to top according to an orientation orthogonal to the road, and transverse, directed from a left side to a right side of the road, these being indicated by the trihedron "L, V, T" in the figures. These orientations are also understood when the elements are installed in a lighting device which is itself installed in position of operation on the vehicle.

Hereinafter in the description, elements that have an identical structure or similar functions will be denoted by the same references.

Figure 1:
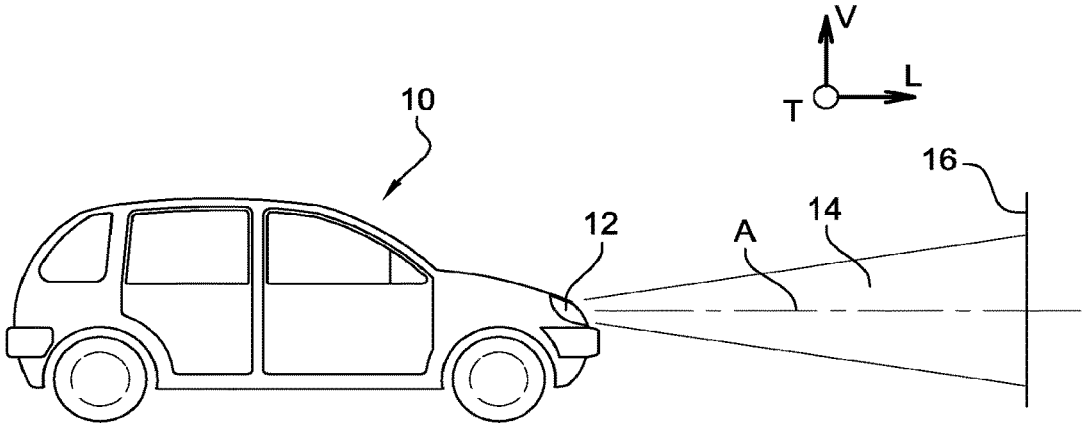
FIG. 1 is a side view which schematically represents a motor vehicle equipped with a lighting module produced according to the teachings of the invention.

FIG. 1 shows a motor vehicle 10 equipped with a lighting device 12, here a headlight 12. The lighting device 12 produces a pixel light beam 14 which produces a determined lighting function. In a nonlimiting manner, it is, here, a high beam function. The pixel light beam 14 is emitted along an axis "A" of emission that is substantially longitudinal to the front of the vehicle 10.

It will be understood that the invention can be applied to light beams fulfilling other functions as has already been explained in the preamble to this description.

For the purposes of the description, a vertical transverse screen 16 has been arranged at a determined longitudinal distance in front of the vehicle 10. The screen 16 is, here, arranged 25 m from the vehicle.

Figure 2:
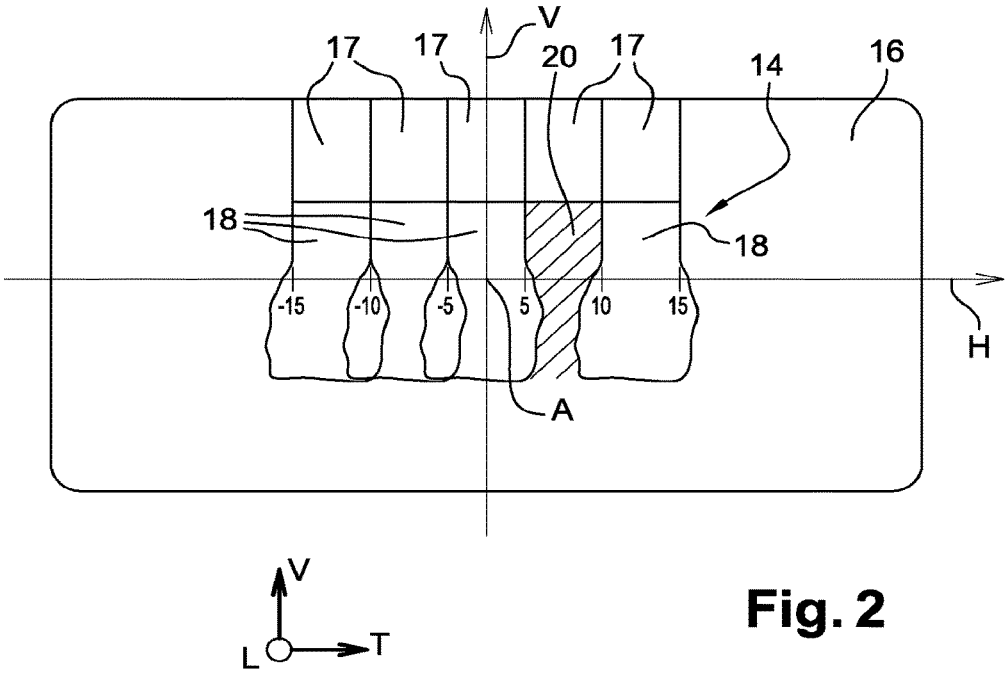
FIG. 2 is a front view which represents a screen lit by a pixel light beam produced by the lighting module of FIG. 1 which comprises several light patterns.

FIG. 2 shows the zones of the screen 16 which are lit by the pixel light beam 14.

On the screen 16, a transverse axis "H" and a vertical axis "V" have been plotted that intersect at the axis "A" of emission of the pixel light beam 14. The axes "H" and "V" are graduated in degrees of aperture of the light beam. The horizontal axis "H" divides the screen 16 into an upper part and a lower part. The parts of the pixel light beam 14 which light the lower part of the screen 16 are intended to light the surface of the road in front of and in proximity to the vehicle, whereas the parts of the pixel light beam 14 which light the upper part of the screen 16 are intended to light above the road.

In the example represented in FIG. 2, the pixel light beam 14 here comprises a transverse alignment of five identical and contiguous light patterns 18. The light patterns referenced 18 light a bottom part of the screen 16. The headlight 12 is also capable of projecting a second row of complementary light patterns 17 which are arranged above the lower row of patterns 18. The set of light patterns 18 and 17 makes it possible to produce the high beam function when they are switched on simultaneously.

The invention specifically relates to the formation of the light patterns 18 of the lower row which overlap the horizontal axis "H" of the screen 16.

The fourth light pattern 18 starting from the left is switched off selectively to form a shadow zone 20. All the light patterns 18 here overlap the horizontal axis "H". Each light pattern 18 lights over a field width less than or equal to 20°, for example a field width less than or equal to 15° or to 10°.

At least one of the light patterns 18 is produced by a lighting module 19 of the motor vehicle headlight 12 comprising at least one light source and optical elements. Such a lighting module 19 will be described in more detail hereinbelow. Each light pattern 18 is projected in a fixed direction relative to the motor vehicle.

The headlight 12 mainly comprises a housing (not represented) which is closed by an outer lens (not represented) through which the pixel light beam is projected. The headlight 12 thus encloses at least the lighting module 19.

Since the light patterns 18 are identical, just one of these light patterns 18 will be described with reference to FIG. 3, the description being applicable to the other light patterns.

Each light pattern 18 is divided into an upper portion 18A and a lower portion 18B which are lit simultaneously and inseparably. Thus, it is not possible to light only the upper portion 18A nor is it possible to light only the lower portion 18B. More particularly, the upper portion 18A and the lower portion 18B are delimited by a transverse line which here runs through the optical axis "A" and which corresponds here to the line "H" of the screen. Thus, the upper portion 18A of the light pattern 18 lights above the road, whereas the lower portion 18B lights the surface of the road in front of and in proximity to the vehicle 10, for example between 5 m and 50 m.

The upper portion 18A is delimited transversely by two so-called sharp vertical edges 20A, 20B, for each of which the light intensity decreases according to a first determined gradient "G1".

The lower portion 18B is delimited transversely by two so-called fuzzy vertical edges 22A, 22B, for each of which the light intensity decreases according to a second determined gradient "G2", lower than said first determined gradient "G1".

The terms "fuzzy" and "sharp" are used relatively. Thus, a sharp first edge will be "sharper" than a fuzzy second edge, that is to say that the gradient of intensity of the sharp edge will be greater than that of the fuzzy edge, and, conversely, the fuzzy second edge will be "fuzzier" than the sharp first edge, that is to say that the gradient of intensity of the fuzzy edge will be lesser than that of the sharp edge.

Figure 4:
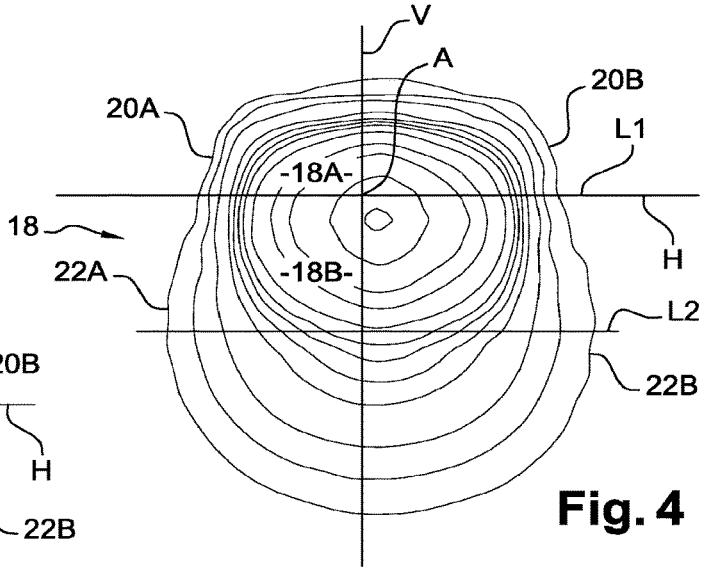
FIG. 4 is a view in terms of isocandela curves which represents the light pattern of FIG. 3.

FIG. 4 shows the isocandela curves of such a light pattern 18, the units of the axes "H" and "V" being angular.

The first determined gradient "G1" of light intensity of the so-called sharp transverse edge 20A has been calculated along a transverse line "L1" running through the axis "H". The first determined gradient "G1" is, here, equal to approximately 0.35. Generally, the first determined gradient "G1" is greater than 0.13, preferably greater than 0.30. This corresponds to a rapid reduction of the intensity when the vertical edge 20A is crossed along the line "L1".

The second determined gradient "G2" of light intensity of the so-called fuzzy transverse edge 22A has been calculated along a transverse line "L2" arranged below the axis "H". The second determined gradient "G2" is, here, equal to approximately 0.11. Generally, the second determined gradient "G2" is less than 0.2, preferably less than 0.13. This corresponds to a slower reduction of the light intensity when the vertical edge 22A is crossed along the line "L2" compared to the reduction of intensity along the line "L1".

More specifically, in the present application, the gradient is obtained in the manner described hereinbelow.

Along the line "L1" or "L2", for any point of a segment extending on either side of the lateral edge for which the gradient is to be measured, the following is calculated:

$$G(\alpha)=\log(I(\alpha+0.05°))-\log(I(\alpha-0.05°))$$

in which $\alpha$ is the angle according to the axis "H" of said point of the segment traveled and I is the intensity of the light beam for the angle considered.

The first or second gradient "G1", "G2" corresponds to the maximum value of $G(\alpha)$ obtained over the segment corresponding to the lateral edge considered.

Thus, when one of the light patterns 18 is switched off, as is illustrated in FIG. 2, the shadow zone 20 which is created on the surface of the road is delimited transversely by so-called fuzzy vertical edges 22A, 22B. Such a configuration makes it possible to not draw the attention of the driver to the delimitation between the shadow zone 20 and the zones lit by the light patterns 18 that are switched on.

Figure 3:
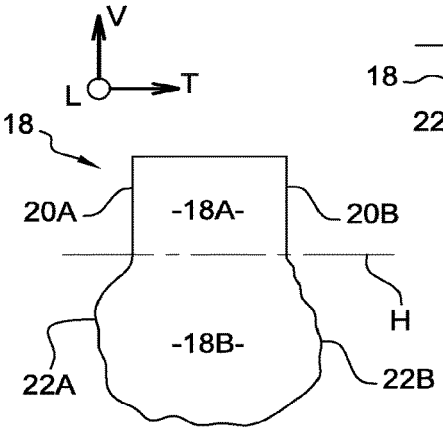
FIG. 3 is a detail view which represents an isolated light pattern of FIG. 2.

In a first embodiment of the light pattern 18 represented in FIGS. 2 to 4, each so-called fuzzy vertical edge 22A, 22B of the lower portion 18B is arranged substantially in the vertical extension of the corresponding so-called sharp vertical edge 20A, 20B of the upper portion 18A.

However, because the lower portion 18B is delimited by so-called fuzzy vertical edges 22A, 22B, it lights a surface that is transversely more extensive than the upper portion 18A.

According to a second embodiment of the light pattern 18, at least one so-called fuzzy vertical edge 22A, 22B of the lower portion 18B is offset transversely relative to the corresponding so-called sharp vertical edge 20A, 20B of the upper portion 18A. In this case, the top end of said offset fuzzy vertical edge 22A, 22B is linked to the bottom end of said sharp vertical edge by a so-called sharp horizontal edge 24A, 24B. The so-called sharp horizontal edge 24A, 24B here coincides with the axis "H" so as not to be perceptible by the driver.

Figure 5:
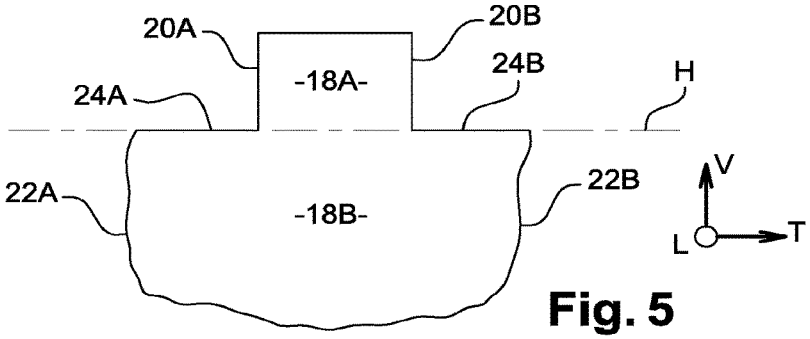
FIG. 5 is a view similar to that of FIG. 3 which represents a variant form of the light pattern.

Thus, according to a first variant of this second embodiment illustrated in FIG. 5, the lower portion 18B of the light pattern 18 is more transversely extensive in both directions relative to the upper portion 18A. In this case, the lower portion 18B is delimited at the top by a so-called sharp first edge 24A, by the upper portion 18A and by a so-called sharp second edge 24B.

Figure 6:
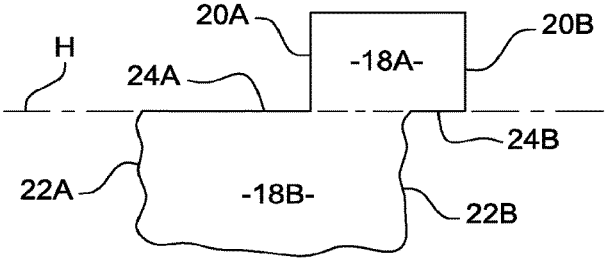
FIG. 6 is a view similar to that of FIG. 3 which represents another variant form of the light pattern.

According to a second variant of this second embodiment illustrated in FIG. 6, the lower portion 18B of the light pattern 18 is entirely offset transversely in a direction relative to the upper portion 18A, here to the left. In this case, the lower portion 18B is delimited at the top by a so-called sharp first edge 24A, by the upper portion 18A. The upper portion 18A is delimited at the bottom by the lower portion 18B and by a so-called sharp second edge 24B.

Figure 7:
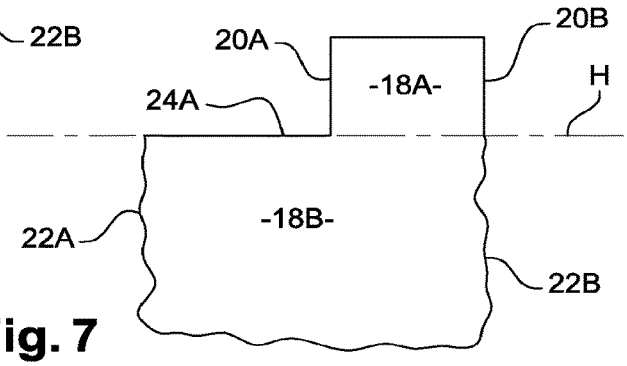
FIG. 7 is a view similar to that of FIG. 3 which represents yet another variant form of the light pattern.

According to a third variant of this second embodiment of the light pattern 18 illustrated in FIG. 7, the lower portion 18B of the light pattern 18 is more transversely extensive in a single direction relative to the upper portion 18A. In this case, the lower portion 18B is delimited at the top by a so-called sharp first edge 24A, by the upper portion 18A. The so-called fuzzy second edge 22B is arranged substantially in the extension of the corresponding so-called sharp edge 20B. The pattern then takes the form of an "L".

Figure 8:
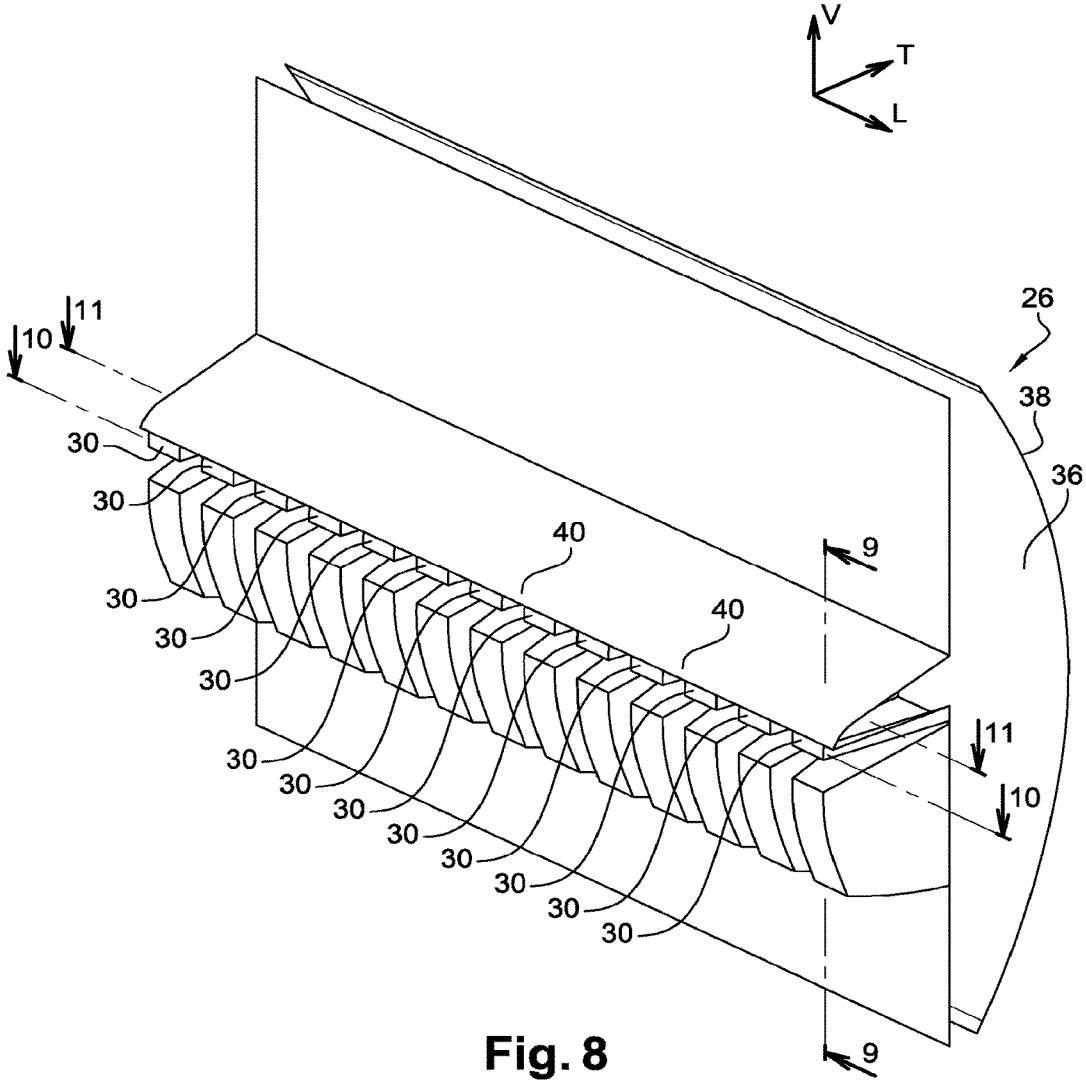
FIG. 8 is a perspective view which represents a primary optical element of the lighting module of FIG. 1 which is produced according to a first embodiment of the invention.
Figure 9:
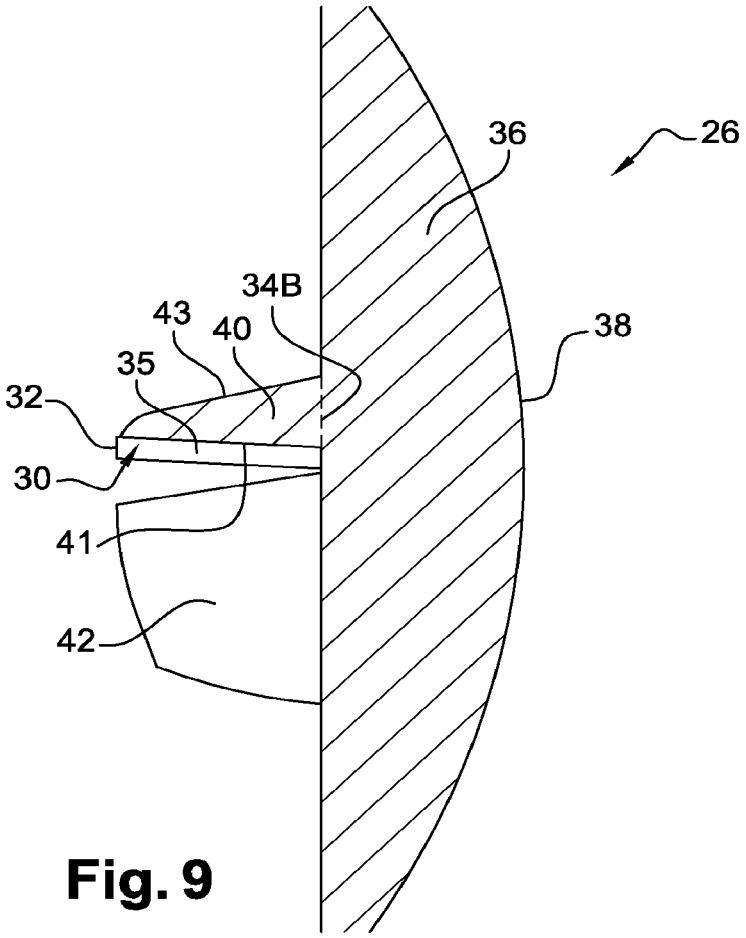
FIG. 9 is a view in longitudinal vertical cross section along the cutting plane 9-9 of FIG. 8 which represents the primary optical element.
Figure 12:
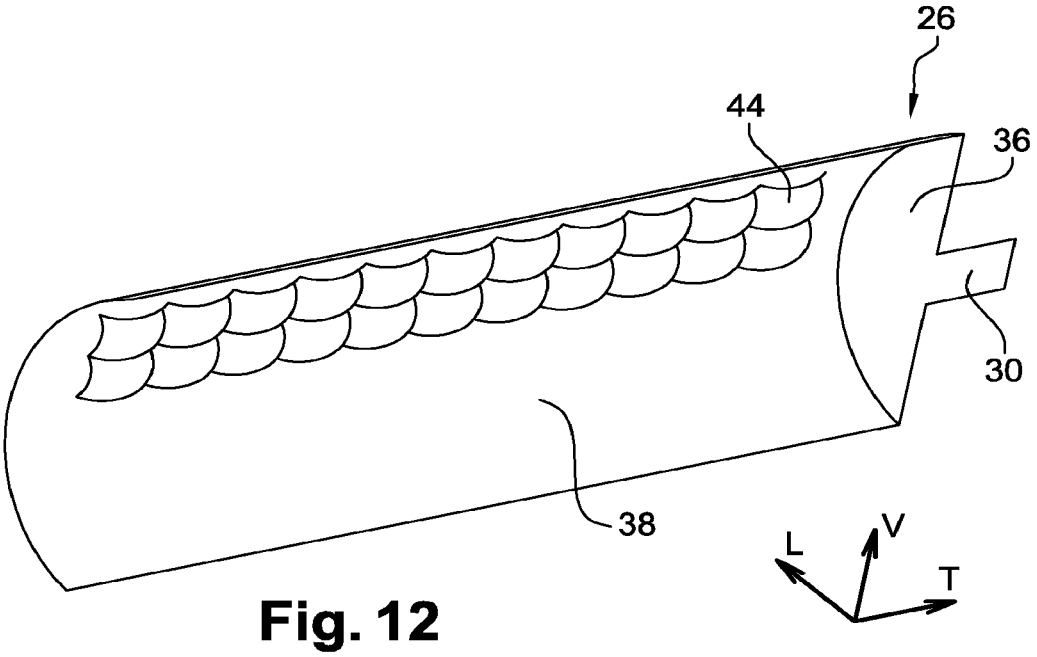
FIG. 12 is a perspective view which represents the primary optical element of the lighting module of FIG. 1 produced according to a second embodiment of the invention.
Figure 10:
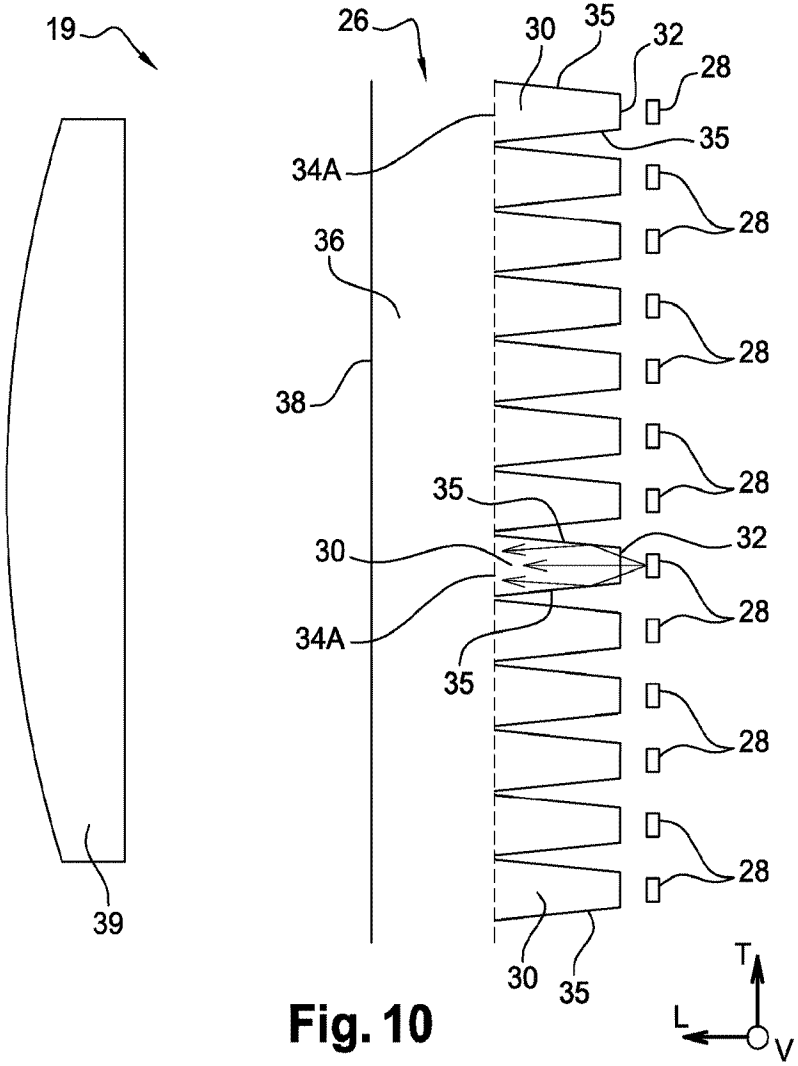

There now follows a description of a lighting module 19 capable of producing at least some of the light patterns forming the pixel light beam 14, as is represented in FIGS. 8 to 10.

The lighting module 19 is designed to form several transversely aligned light patterns 18. Said light patterns 18 are contiguous, even overlap, transversely, in order to form a pixel light beam 14 lighting uniformly when all the light patterns 18 are switched on.

Each light pattern 18 is capable of being controlled independently to participate in the formation of the pixel light beam 14 producing a determined lighting function, for example a high beam.

The lighting module 19 comprises a primary optical element 26 associated with a plurality of light sources 28, each of which is associated with a light pattern 18.

Each light source 28 is, for example, a light-emitting diode belonging to a matrix of light-emitting diodes. The light sources 28 are, here, aligned transversely.

The primary optical element 26 comprises a plurality of light guides 30 which form a transverse row. Each light guide 30 extends overall longitudinally from a rear input face 32 for the light emitted by an associated light source 28 to a front light output face 34.

In a preferred embodiment, each light guide 30 is associated with one of the light sources 28. According to a variant, each light guide 30 is associated with several of the light sources 28.

The input faces 32 are in one and the same vertical transverse plane parallel to the plane of the light-emitting diodes 28. The output faces 34 are also arranged in one and the same transverse vertical plane. A transverse space is reserved between two adjacent light guides 30 to allow the guiding of the light rays by total internal reflection on the lateral faces of the light guides 30.

Each light guide 30 has a transverse cross section of rectangular form. Each light guide 30 thus has two vertical lateral faces 35 and two top and bottom faces.

The primary optical element 26 also comprises a front lens 36. The front lens 36 is delimited longitudinally to the front by a face 38 for forming the light patterns 18 and to the rear with a transverse vertical face which coincides with the plane of the output faces 34 of the light guides 30.

The front lens 36 is, here, produced materially in a single piece with the light guides 30. Thus, the light guides 30 emerge directly in the front lens 36. The light rays outgoing from the output faces 34 of the light guides are thus propagated without being deflected to the output face 38 of the front lens 36.

The lighting module 19 also comprises a front end projection lens 39, represented in FIG. 9, which is arranged longitudinally in front of and at a distance from the output face 38 of the front lens 36. The projection lens 39 is intended to project a vertically inverted image of the output faces 34 of the light guides to infinity. Thus, an upper portion 34B of the output face 34 of a light guide 30 is intended to form the lower portion 18B of the associated light pattern 18, whereas a lower portion 34A of the output face 34 of the light guide 30 is intended to form the upper portion 18A of the associated light pattern 18.

According to a first embodiment of the lighting module 19, an upper portion of each lateral face 35 of each light guide 30 is linked to the lateral faces 35 of the adjacent light guides 30 via a transverse bridge 40 produced materially and in a single piece with the light guides. Each bridge 40 extends longitudinally from the plane of the input faces 32 to the plane of the output faces 34, here to the front lens 36. Each bridge 40 is arranged transversely coinciding with the upper portion 34B of the output face of the light guides 30. Furthermore, all the bridges 40 are delimited by a bottom face 41 and by a top face 43. The top face 43 is arranged in the same plane as the top faces of the light guides 30. The bottom faces 41 are arranged in a common horizontal plane.

In this configuration, the upper parts of the light guides 30 thus linked by the bridges 40 form a single light forming layer which extends transversely over the entire row of the light guides 30 and which has a single output face 34B extending transversely all along the row of light guides 30. Only a lower part of the lateral faces 35 of the light guides remains free, as is represented in FIGS. 8 and 9. In a variant of the invention that is not represented, some light guides are not linked by bridges. Thus, the primary optical element has several light forming layers each of which encompasses several light guides and each of which has an associated output face.

In the embodiment of FIG. 8, each bridge 40 has a thickness approximately equal to half the height of the lateral face 35 of the light guide 30. As a variant, the thickness of each bridge can also be less than half said height.

According to a variant of the invention that is not represented, the thickness of the bridges varies as a function of their position along the primary optical element.

Figure 11:
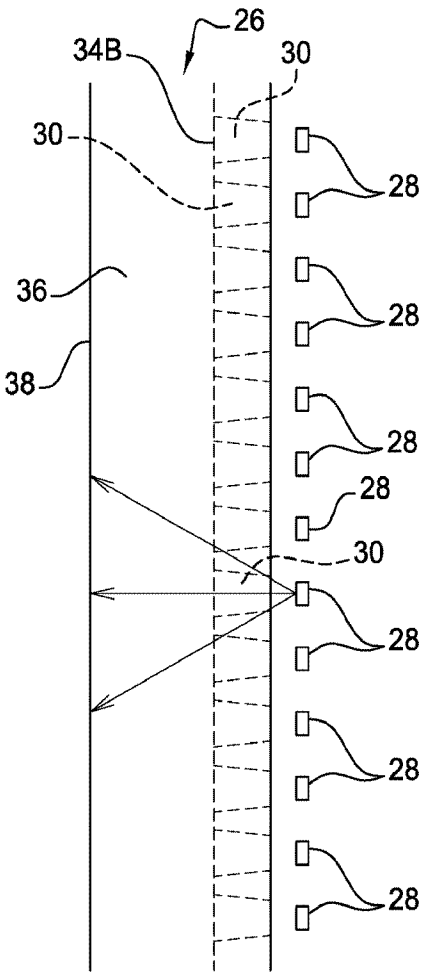

To illustrate the operation of the lighting module 19, FIGS. 10 and 11 show a single light source 28 switched on to form a light pattern 18, the other light sources 28 being switched off. FIGS. 10 and 11 represent the same light source 28 switched on.

As is represented in FIG. 10, the upper portion 18A of the light patterns 18 is produced by the lower parts of light guides 30 separated transversely from one another by a space. This configuration allows the free lateral faces 35 of the light guide 30 to reflect the light by total internal reflection to concentrate the light rays towards the lower portion 34A of the output face 34. This thus makes it possible to form the so-called sharp vertical edges of the upper portion 18A of the light pattern 18.

As is illustrated in FIG. 11, the bridges 40 produced on either side of the upper part of the light guides 30 allow the light rays to continue their propagation in a straight line beyond the lateral face 35 to exit over a more transversely extensive surface of the upper portion of the output face 34B than the lower portion 34A of the output face. The lower portion 18B of the light pattern 18 is thus obtained. It is thus observed that the light rays emitted by a light source 28 exit through an upper portion of output face 34B which encroaches on the output face of the adjacent light guides 30.

The forming layer formed by the bridges 40 makes it possible to obtain a light pattern 18 in the form of an inverted "T" as represented in FIGS. 3 and 4. An inverted "T" should be understood to mean a pattern having an upper portion of substantially constant width and a lower portion wider than the upper portion and extending laterally on either side of the upper part.

In a variant of the invention that is not represented, when the horizontal faces of the bridges are fairly wide, in particular wider than what is represented in FIG. 8, they make it possible to produce the light pattern 18 represented in FIG. 5. In this case, the bottom horizontal faces of the bridges 40 in fact make it possible to create so-called sharp horizontal edges which link the so-called sharp vertical edges 20A, 20B, formed by the lateral faces of the light guides 30, with the so-called fuzzy vertical edges 22A, 22B, formed by the bridges 40.

In the example represented in FIGS. 8 to 11, the primary optical element 26 also comprises a second row of light guides 42 which make it possible to obtain the complementary light patterns 17 of rectangular form delimited transversely by so-called sharp vertical edges over all their height. These complementary light patterns 17, represented in FIG. 2, are intended to light only above the road.

According to a second embodiment of the lighting module 19 which is represented in FIG. 11, the light guides remain separated from one another by a space over all their vertical height. On the other hand, a portion of the output face 38 of the front lens 36 of the primary optical element 26 has means for transversely spreading the light rays intended to light the lower portion 18B of the light pattern 18. Indeed, the output face 38 is sufficiently close to the focal plane of the system, for example the output face is arranged at a distance from the focal plane of between 2% and 20% of the focal length of the system. In this way, a diffraction or refraction structure arranged on an upper part of the output face 38 affects only a lower part of the light pattern 18.

The light spreading means are for example formed by diffraction or refraction structures produced in relief on a portion of the output face 38. The diffraction or refraction structures are for example conformed as cushions 44.

This second embodiment makes it possible to obtain light patterns of a form similar to that represented in FIG. 3.

As a variant, the spreading means are formed by a graining of the corresponding parts of the output face.

According to another variant, the diffraction or refraction structures are formed by striations, undulations, prisms or any other form suitable for producing the light spreading function.

A third embodiment is also provided, not represented, in which the primary element comprises a structure with light-forming layers, as in the first embodiment, of which the output face comprises light spreading means, as in the second embodiment. The third embodiment of the invention thus combines the features of the first and second embodiments of the invention.

The invention claimed is:

1. A lighting module for a motor vehicle headlight comprising a plurality of light sources and a primary optical element for forming a plurality of light patterns, wherein:

each light pattern is divided into an upper portion and a lower portion which are lit simultaneously and inseparably, the upper portion being delimited transversely by two vertical edges for each of which the light intensity decreases according to a first determined gradient, and the lower portion being delimited transversely by two vertical edges for each of which the light intensity decreases according to a second determined gradient lower than said first determined gradient, the plurality of light patterns are contiguously aligned transversely and controlled independently of one another to participate in the formation of a pixel light beam, the primary optical element is associated with the plurality of light sources each of which is associated with one of the plurality of light patterns, the primary optical element comprising a light output face and a plurality of adjacent light guides each associated with one of the light sources, and wherein the lower portions of the light patterns are produced by joining a corresponding part of the lateral faces of the adjacent light guides to form a forming layer, the upper portions of the light patterns being produced by a portion of the lateral faces of the light guides separated transversely from one another.

2. The lighting module according to claim 1, wherein the first determined gradient is greater than 0.13.

3. The lighting module according to claim 1, wherein the second determined gradient is less than 0.2.

4. The lighting module according to claim 1, wherein the first determined gradient is greater than 0.30.

5. The lighting module according to claim 1, wherein the second determined gradient is less than 0.13.

6. The lighting module according to claim 1, wherein at least one vertical edge of the lower portion is arranged in the vertical extension of the vertical edge of the upper portion.

7. The lighting module according to claim 6, wherein the two vertical edges of the lower portion are arranged in the extension of each vertical edge of the upper portion.

8. The lighting module according to claim 1, wherein at least one vertical edge of the lower portion is offset transversely relative to the corresponding vertical edge of the upper portion, said vertical edge being linked to said vertical edge by a horizontal edge.

9. The lighting module according to claim 1, wherein the light pattern lights over a field width less than 20°.

10. The lighting module according to claim 1, wherein the output face of the primary optical element has means for transversely spreading the light rays intended to light the lower part of the light pattern.

11. The lighting module according to claim 10, wherein the means for transversely spreading the light rays are formed by refractive or diffractive structures produced on the output face.

12. The lighting module according to claim 11, wherein the refractive or diffractive structures comprise at least one of cushions, a graining, striations, undulations, and prisms.

13. A motor vehicle headlight comprising at least one lighting module according to claim 1.

14. The lighting module according to claim 2, wherein the second determined gradient is less than 0.2.

15. The lighting module according to claim 2, wherein the second determined gradient is less than 0.13.

16. The lighting module according to claim 2, wherein at least one vertical edge of the lower portion is arranged in the vertical extension of the vertical edge of the upper portion.

17. The lighting module according to claim 2, wherein at least one vertical edge of the lower portion is offset transversely relative to the corresponding vertical edge of the upper portion, said vertical edge being linked to said vertical edge by a horizontal edge.

18. The lighting module according to claim 1, wherein the light pattern lights over a field width less than 15°.

19. A motor vehicle headlight comprising at least one lighting module according to claim 2.

* * * * *